US009630047B1

(12) United States Patent
Boss

(10) Patent No.: US 9,630,047 B1
(45) **Date of Patent: *Apr. 25, 2017**

(54) EXERCISE MACHINE

(71) Applicant: Dimitry Ralph Boss, Hillsdale, NJ (US)

(72) Inventor: Dimitry Ralph Boss, Hillsdale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/295,948

(22) Filed: Oct. 17, 2016

Related U.S. Application Data

(63) Continuation-in-part of application No. 14/995,128, filed on Jan. 13, 2016.

(51) Int. Cl.
*A63B 21/16* (2006.01)
*A63B 21/00* (2006.01)

(52) U.S. Cl.
CPC ..... *A63B 21/16* (2013.01); *A63B 21/4029* (2015.10)

(58) Field of Classification Search
CPC ..... A63B 21/00047; A63B 21/00185; A63B 21/068; A63B 21/4011–21/4015; A63B 22/18–2022/185; A63B 2069/0062
See application file for complete search history.

(56) References Cited

U.S. PATENT DOCUMENTS 6,231,487 B1 * 5/2001 Diamond, Jr. ..... A63B 21/026 482/121
7,407,467 B2 * 8/2008 Diamond, Jr. ..... A63B 21/4025 482/121
8,529,416 B2 * 9/2013 Jennings ..... A63B 21/015 482/114

* cited by examiner

*Primary Examiner* — Loan H Thanh
*Assistant Examiner* — Jennifer M Deichl
(74) *Attorney, Agent, or Firm* — Quickpatents, LLC; Kevin Prince

(57) ABSTRACT

An exercise apparatus includes foot docking station comprising a base plate pivotally fixed to a back plate at a hinge. The back plate includes a central pivot rotationally fixed with a foot plate that includes a shin engagement mechanism for engaging the shins of the person. The foot docking station is selectively attachable to a lower bench. A distal leg is fixed with the lower bench at a rotational leg mount, the lower bench including a receiver for engaging an upper bench. A proximal leg is fixed with the upper bench at another rotational leg mount. An auxiliary bench may be fixed with the upper and lower benches.

12 Claims, 6 Drawing Sheets

EXERCISE MACHINE

CROSS-REFERENCE TO RELATED APPLICATIONS

This application is a Continuation-in-Part of U.S. Utility patent application Ser. No. 14/995,128, filed on Jan. 16, 2016, and incorporated herein by reference.

STATEMENT REGARDING FEDERALLY SPONSORED RESEARCH AND DEVELOPMENT

Not Applicable.

FIELD OF THE INVENTION

This invention relates to exercise devices, and more particularly to a multi-use exercise bench and foot docking station.

DISCUSSION OF RELATED ART

The prior art is replete with exercise devices for allowing a user to perform a number of different exercise. Often it is desired that exercise devices allow for a large number of different exercises that exercise a multiple number of muscle groups, such as the torso, core, mid-section, rectus abdominals, transversus abdominis, lower back, internal oblique, external oblique, latissimus dorsi, serratus anterior, serratus posterior inferior, erector spinae, external intercoastal, gluteus maximus, and gluteus medius muscle groups. Heretofore, however, any exercise device that purports to allow exercise of many of these muscle groups is relatively bulky and difficult to transport, store and use.

Therefore, there is a need for a device that allows exercising of all of these muscle groups through versatile adjustment of height, angle, and rotation of various components thereof. Such a needed device would be relatively compact when collapsed into a retracted position for ease of transportation and storage. Such a needed invention would further be relatively inexpensive to manufacture, and easy to set-up, reconfigure and use. The present invention accomplishes these objectives.

SUMMARY OF THE INVENTION

The present device is an exercise apparatus for use by a person on a support surface, such as a floor. A foot docking station comprises a base plate pivotally fixed to a back plate at a hinge. The back plate includes a central pivot rotationally fixed with a bottom side of a foot plate. A shin engagement mechanism extends away from a top side of the foot plate and includes a pair of cushioned, arched shin pads projecting laterally away therefrom. Optionally the arched shin pads may be fixed on a shin pad trolley that is adjustably moved closer or farther away from the foot plate with a retention pin or other similar mechanism for moving the arched shin pads up and down with respect to the foot plate.

Preferably the base plate and foot plate further include a rotational locking mechanism adapted for selectively locking the relative rotational position between the back plate and the foot plate. The base plate may further include a weight rod projecting upwardly therefrom and adapted to receive at least one annular weight thereon.

The exercise apparatus may further include a lower bench comprising a rigid elongated lower shaft having a proximal end and a distal end adapted for engaging the foot docking station with at a plurality of the second pin receivers. When the foot docking station is engaged with the lower bench, the base plate is removed and replaced with the lower shaft.

A distal leg is fixed with the distal end of the lower shaft at a rotational leg mount. The distal leg is positionable between a retracted position aligned with and adjacent to the lower shaft, and a plurality of extended positions. In such an embodiment, the rotational leg mount includes a rotational lock adapted for selective locking of the relative rotational position of the distal leg and the lower shaft. The distal leg terminates at a distal end thereof with at least one surface grip.

Preferably the proximal end of the lower shaft of the lower bench further includes a receiver for engaging an upper bench. A rigid, elongated upper shaft of the upper bench has a proximal end and a distal end adapted for engaging the receiver of the lower shaft. A proximal leg is fixed with the proximal end of the upper shaft at another rotational leg mount at a proximal end thereof, identically to that of the distal leg except rotated 180-degrees. In such an embodiment, the distal end of the upper shaft and the receiver of the lower shaft include a second pin locking mechanism, such that a locking pin may be used to selectively lock the proximal end of the lower shaft to the distal end of the upper shaft.

Preferably a pair of wheels extends past the proximal end of the upper shaft and a pulling handle is fixed with the lower shaft for rolling the apparatus along the support surface upon the pair of wheels.

An auxiliary bench may be selectively attached to the upper and lower benches by removing the foot docking station. As such, by positioning the proximal and distal legs, in their various positions, the auxiliary bench may be reclined, inclined, or level. The apparatus may further include a seat fixed with the proximal end of the upper shaft, as well as a pair of rigid hand grips and a pair of knee supports for performing various leg exercises while being able to sit on the seat and hold onto the apparatus manually at the hand grips.

In my previous U.S. Utility patent application Ser. No. 14/995,128, filed on Jan. 16, 2016, I solved the problems associated with the prior art. Herein I have expanded on the solutions to these problems with an apparatus having fewer parts and a lower manufacturing cost. The present device allows exercising of the torso, core, mid-section, rectus abdominals, transversus abdominis, lower back, internal oblique, external oblique, latissimus dorsi, serratus anterior, serratus posterior inferior, erector spinae, external intercoastal, gluteus maximus, and gluteus medius muscle groups through versatile adjustment of height, angle, and rotation of various components of the apparatus. The present device is relatively compact when collapsed into a retracted position for ease of transportation and storage, and is relatively inexpensive to manufacture, easy to set-up, reconfigure and use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1A:
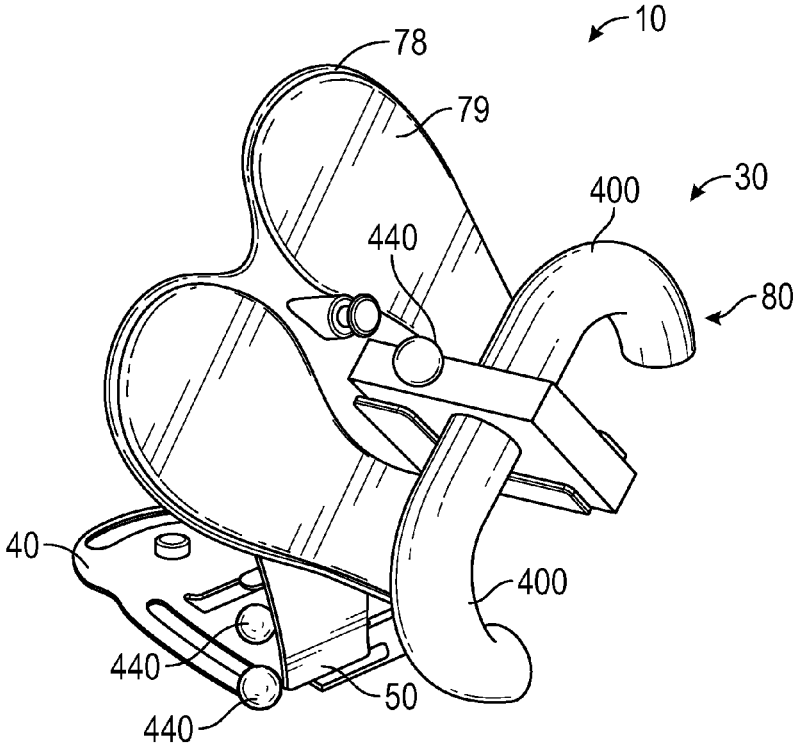
FIG. 1A is a front perspective view of a foot docking station of the invention.
Figure 1B:
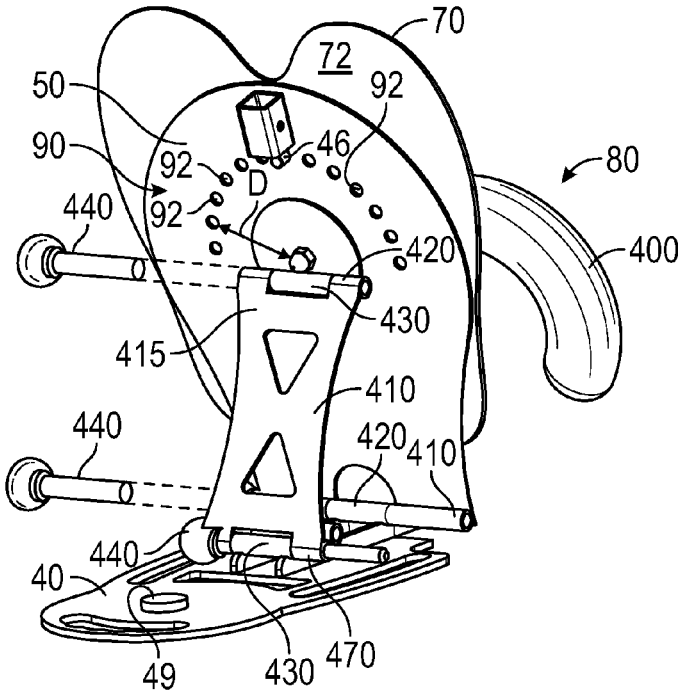
FIG. 1B is a rear perspective view thereof.
Figure 2A:
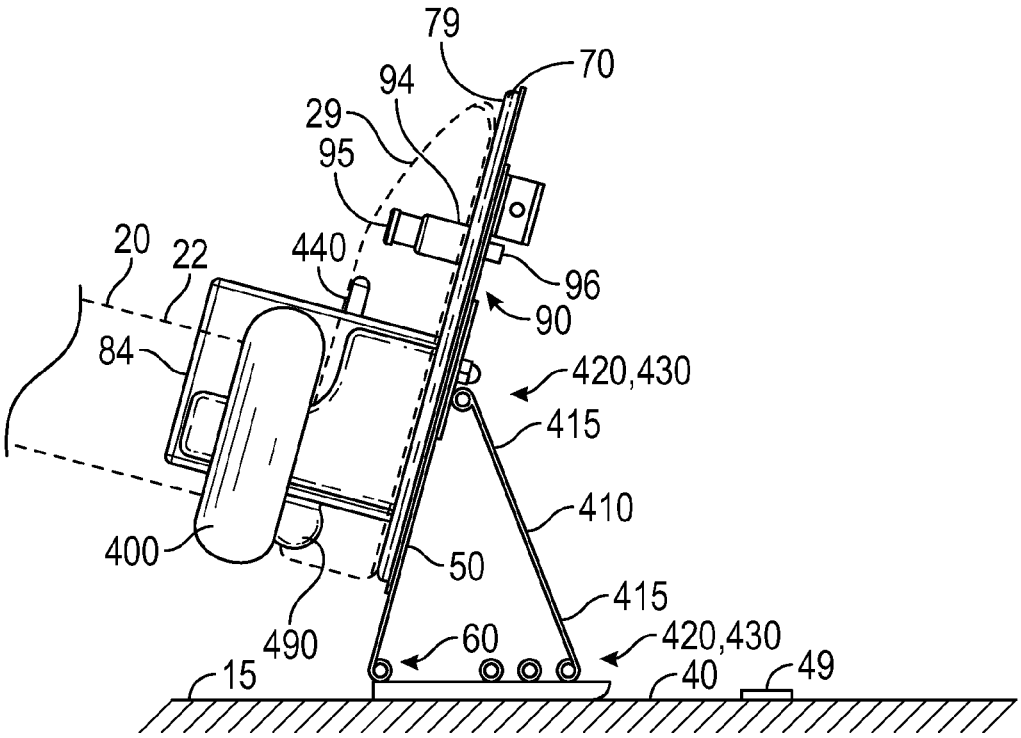
FIG. 2A is a side elevational view thereof.
Figure 2B:
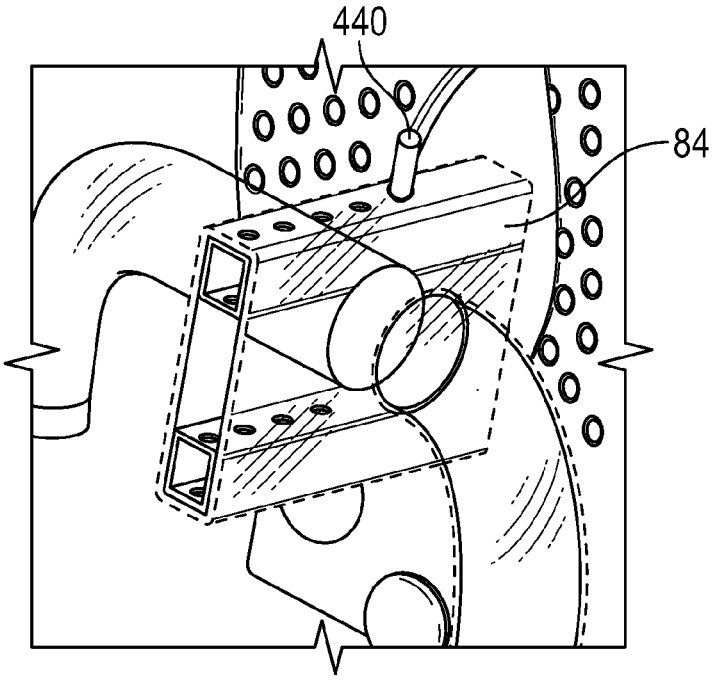
FIG. 2B is a perspective view of a shin pad trolley of the foot docking station, illustrated as partially transparent for clarity of illustration.

FIGS. 1-2 illustrate an exercise apparatus 10 for use by a person 20 on a support surface 15, such as a floor. A foot docking station 30 comprises a rigid, preferably metallic base plate 40 pivotally fixed to a rigid, preferably metallic back plate 50 at a hinge 60. The back plate 50 includes a central pivot 55 rotationally fixed with a bottom side 72 of a rigid, preferably metallic foot plate 70.

The foot plate 70 has a shin engagement mechanism 80 extending away from a top side 78 thereof for engaging the shins 22 of the person 20 while the person's feet 24 contact the top side 78 of the foot plate 70 or a cushion 79 affixed thereto. The shin engagement mechanism 80 includes a pair of cushioned, arched shin pads 400 projecting laterally away therefrom. Optionally the arched shin pads 400 may be fixed on a shin pad trolley 84 that is adjustably moved closer or farther away from the foot plate 70 with a retention pin 440, or other similar mechanism for moving the arched shin pads 400 up and down with respect to the foot plate 70.

Preferably the base plate 40 and foot plate 70 further include a rotational locking mechanism 90 adapted for selectively locking the relative rotational position between the back plate 40 and the foot plate 70. Such a rotational locking mechanism 90 may include, for example, a plurality of locking apertures 92 each arranged a common distance D from the central pivot 55 and a release pin arrangement 94 and pin 96 arrangement fixed with the foot plate 72 and biased to urge the pin 96 into one of the locking apertures 92. As such, the user 20 can pull the release pin 96 out of the locking aperture 92 to allow the foot plate 70 to rotate about the pivot 55 with respect to the back plate 50. The release pin arrangement 94 may be set in a fully retracted position (not shown) if desired so that the foot plate 70 freely rotates on the back plate 50 during exercising.

Preferably the base plate 40 further includes a weight rod 49 (FIG. 1) projecting upwardly therefrom and adapted to receive at least one annular weight (not shown) thereon. Alternately, a door or other heavy item (not shown) may be engaged with the weight rod 49 or base plate 40 to maintain the base plate 40 on the support surface 15.

Figure 3:
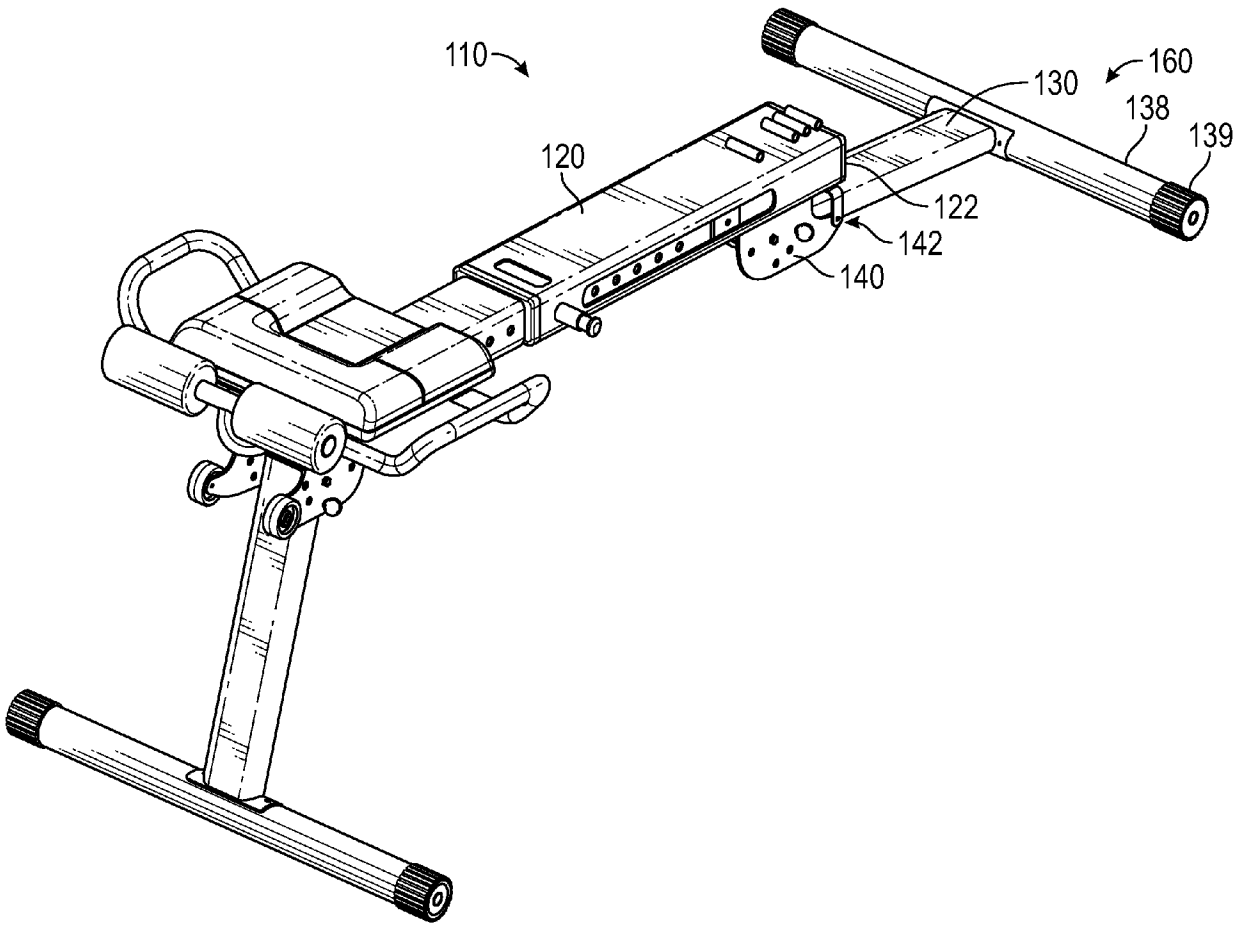
FIG. 3 is a perspective view of an alternate embodiment of the invention that includes a lower bench and an upper bench, the foot docking station omitted for clarity of illustration.
Figure 4:
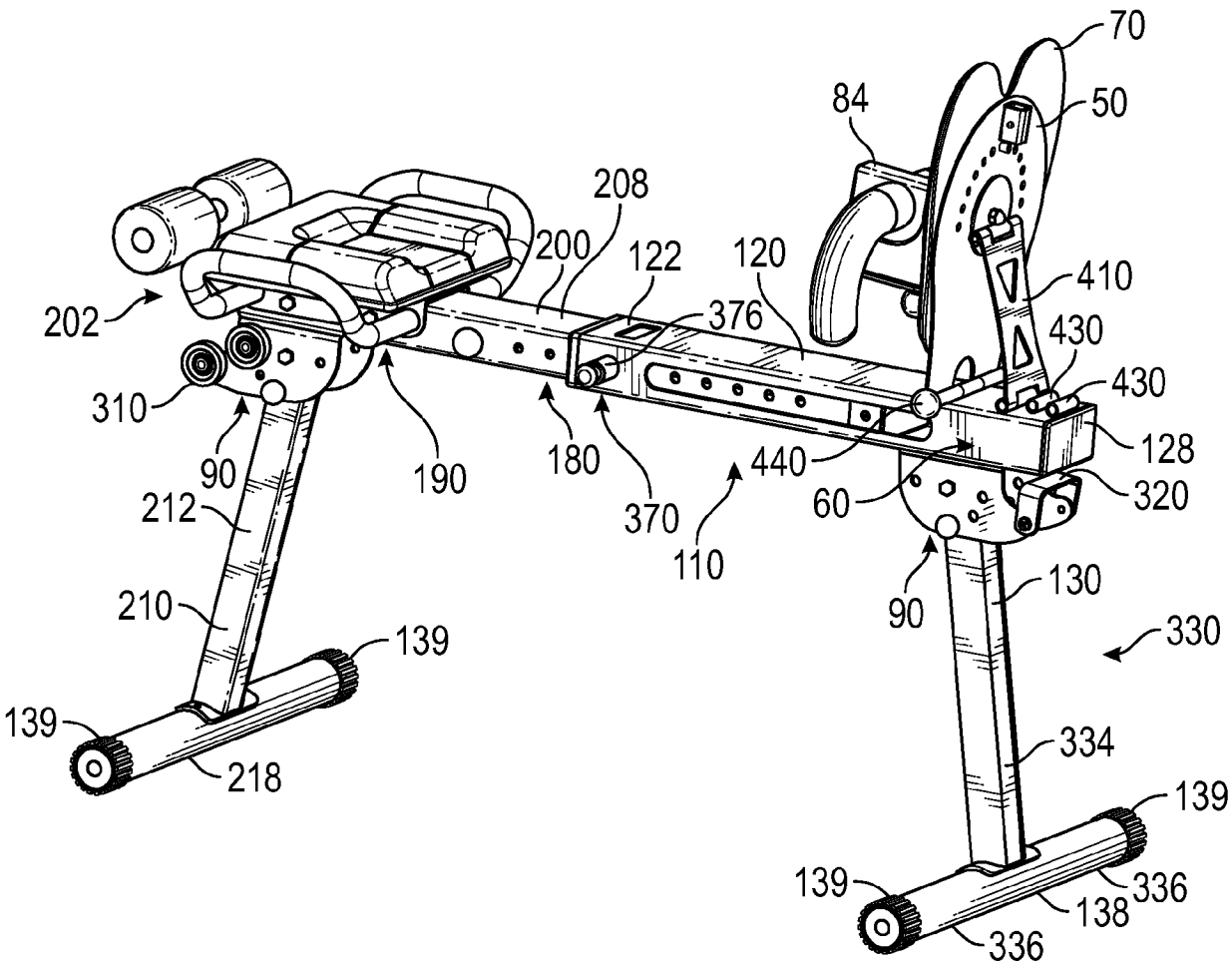
FIG. 4 is a perspective view of FIG. 3 but including the foot docking station.
Figure 5:
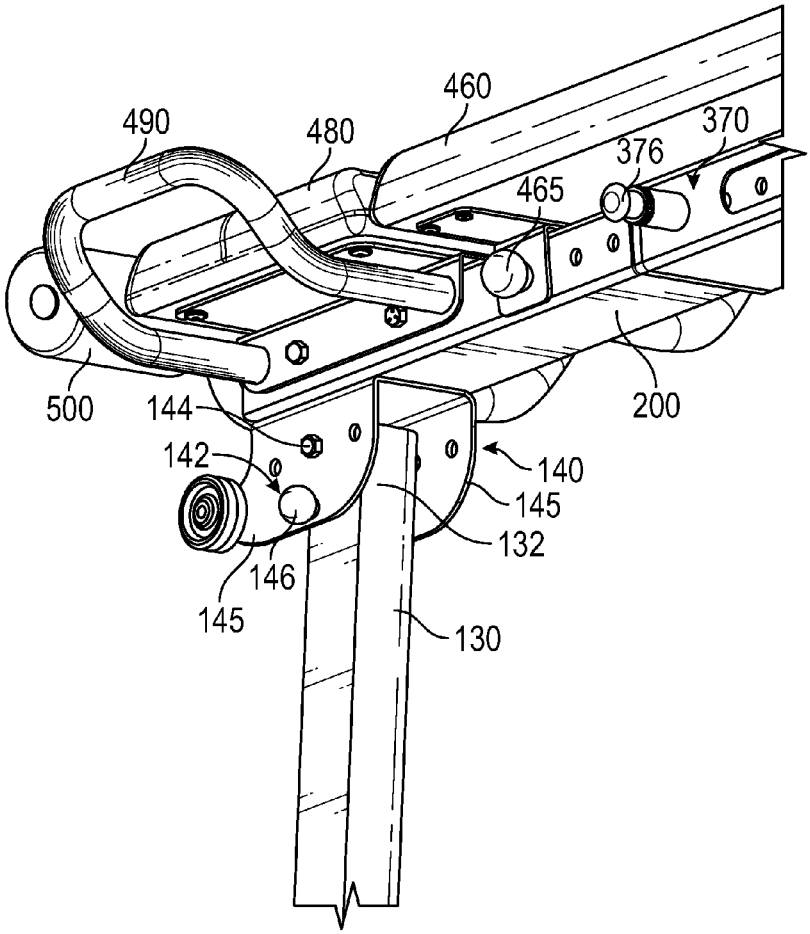
FIG. 5 is an enlarged perspective view of the upper bench and a rotational leg mount.

Preferably the exercise apparatus 10 further includes a lower bench 110 (FIGS. 3 and 4). The lower bench comprises a rigid, preferably metallic, elongated lower shaft 120 having a proximal end 122 and a distal end 128 adapted for engaging the foot docking station 30 with at a plurality of the second pin receivers 430. When the foot docking station 30 is engaged with the lower bench 110, the base plate 40 is removed and replaced with the lower shaft 120 (FIG. 4).

A distal leg 130 is fixed with the distal end 128 of the lower shaft 120 at a rotational leg mount 140. The distal leg 130 is positionable between a retracted position 150 (FIG. 6) aligned with and adjacent to the lower shaft 120, and a plurality of extended positions 160 (FIGS. 3-5, 7 and 8). In such an embodiment, the rotational leg mount 140 includes a rotational lock 142 adapted for selective locking of the relative rotational position of the distal leg 130 and the lower shaft 120. The distal leg 130 terminates at a distal end 138 thereof with at least one surface grip 139.

Preferably the distal leg 130 includes a single T-shaped leg 330 having a main shaft 334 and two laterally projecting shafts 336. The rotational leg mount 140 includes an axle 144 (FIG. 5) traversing the proximal end 132 of the distal leg 130. The rotational lock 142 includes at least one locking plate 145 through which a pin 146 can engage any one of a plurality of pin stops 147 to selectively lock the relative rotational position of the distal leg 130 and the lower shaft 120.

Preferably the proximal end 122 of the lower shaft 120 of the lower bench 110 further includes a receiver 180 for engaging an upper bench 190 (FIGS. 7-13C). A rigid, preferably metallic, elongated upper shaft 200 has a distal end 208 adapted for engaging the receiver 180 of the lower shaft 120, and a proximal end 202. A proximal leg 210 is fixed with the proximal end 202 of the upper shaft 200 at another rotational leg mount 140 at a proximal end 212 thereof, identically to that of the distal leg 130 except oriented 180-degrees such that the proximal leg 210 may extend beyond the proximal end 202 of the upper shaft 200 when in a most extreme extended position 160. The proximal leg 210 terminates at a distal end 218 thereof with at least one of the surface grips 139.

In such an embodiment, the distal end 208 of the upper shaft 200 and the receiver 180 of the lower shaft 120 include a second pin locking mechanism 370 (FIG. 7), such that a locking pin 376 may be used to selectively lock the proximal end 122 of the lower shaft 120 to the distal end 208 of the upper shaft 200.

Preferably a pair of wheels 310 (FIGS. 5 and 6) extends past the proximal end 202 of the upper shaft 200. The distal end 128 of the lower shaft 120 includes a pulling handle 320. As such, with the proximal and distal legs 210,130 each in their retracted positions 150, the pulling handle 320 may be lifted and pulled to roll the apparatus 10 along the support surface 15 upon the third pair of wheels 310.

Figure 6:
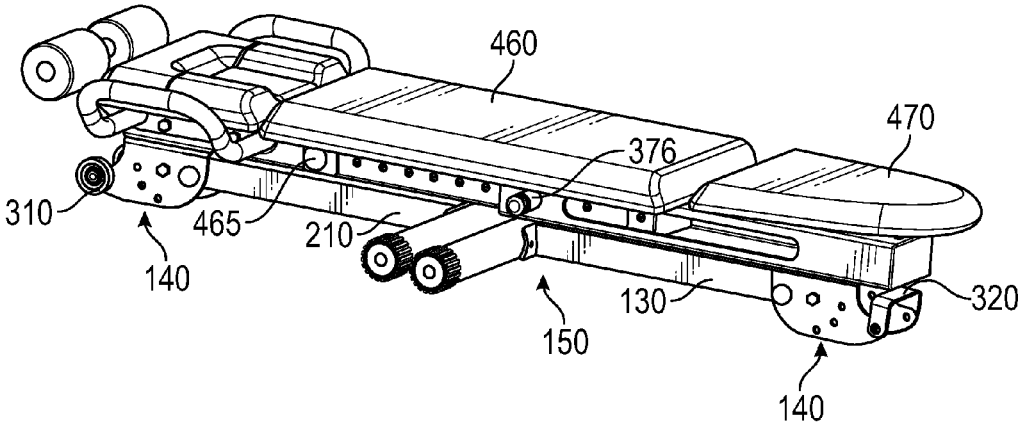
FIG. 6 is a perspective view of the apparatus in a retracted configuration, illustrated with an auxiliary bench attached thereto and with the foot docking station removed.
Figure 7:
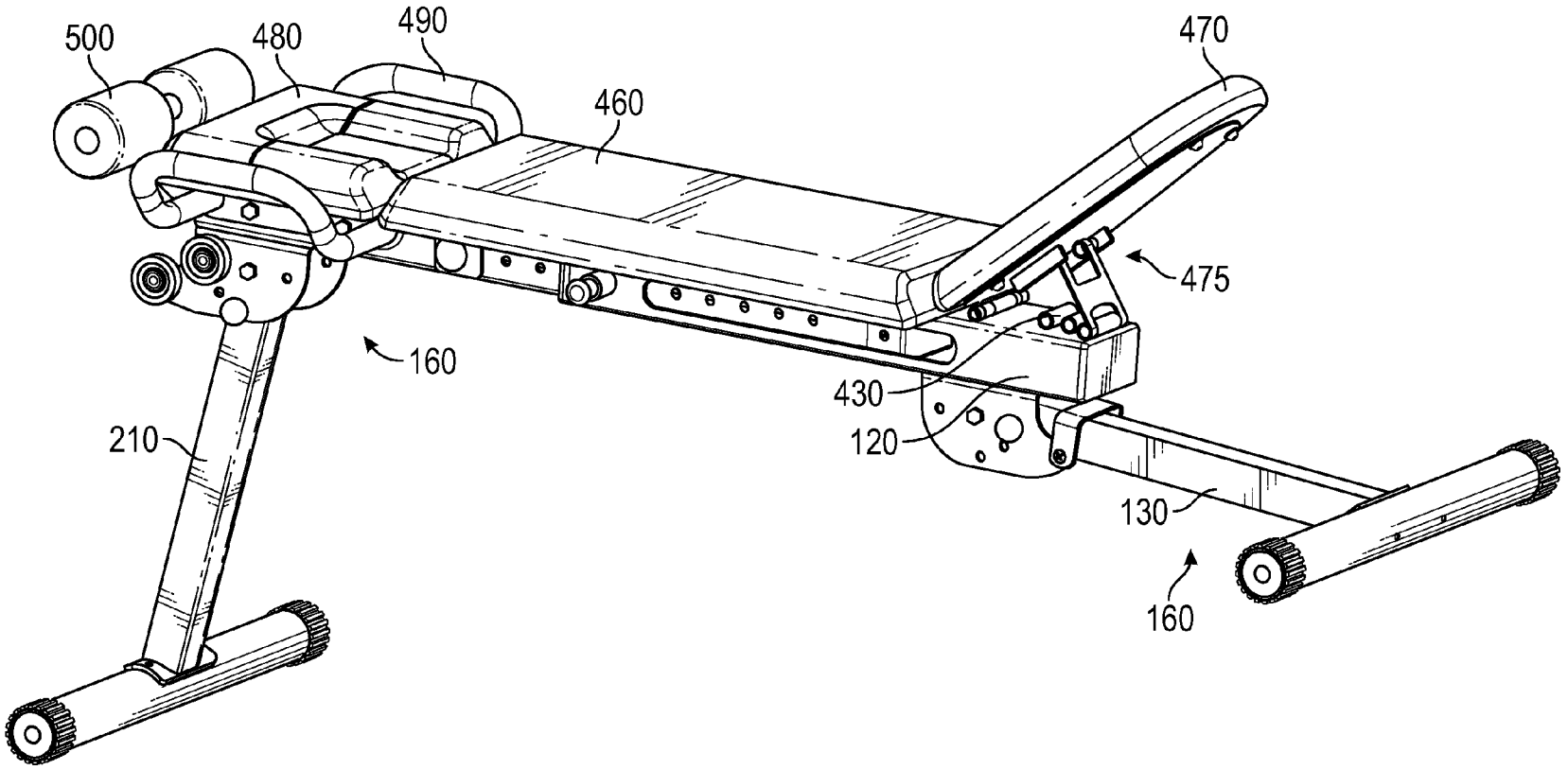
FIG. 7 is a perspective view of FIG. 6 but with a portion of the auxiliary bench and the distal and proximal legs in alternate extended configurations.

An auxiliary bench 460 (FIGS. 5-7) may be attached to the upper and lower benches 190,110 by removing the foot docking station 30. The auxiliary bench 460 may be selectively attached to the upper and lower benches 190,110 at a pair of mechanical fastener pins 465. As such, by positioning the proximal and distal legs 210,130 in their various positions, the auxiliary bench 460 may be reclined, inclined, or level. An optional pivotal seat section 470 may be included at the distal end of the auxiliary bench 360 and separably inclined with respect to the auxiliary bench 460 (FIG. 7), or rotated to become aligned with the auxiliary bench 460 (FIG. 6). A bracket and pin mechanism 475 cooperative with the plurality of second pin receivers 430 of the lower shaft 120 is included for selectively positioning the rotation of the seat section 470 with respect to the auxiliary bench 460.

The apparatus 10 may further include a seat 480 fixed with the proximal end 202 of the upper shaft 200 (FIGS. 5 & 8), as well as a pair of rigid hand grips 490 and a pair of knee supports 500 for performing various leg exercises while being able to sit on the seat 480 and hold onto the apparatus 10 manually at the hand grips 490.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. An exercise apparatus for use by a person on a support surface, the apparatus comprising:

a foot docking station comprising a base plate pivotally fixed to a back plate at a hinge, the back plate including a central pivot rotationally fixed with a bottom side of a foot plate, the foot plate having a shin engagement mechanism extending away from a top side thereof for engaging the shins of the person while the person's feet contact the top side of the foot plate, the shin engagement mechanism including a pair of arched shin pads projecting laterally away therefrom;

whereby with the base plate fixed with the support surface and the person's feet contacting the foot plate, the foot plate may be rotated by the person to a desired rotational orientation for performing an exercise on the support surface.

2. The exercise apparatus of claim 1 further including a brace plate terminating at opposing ends thereof each with a first pin receiver, and wherein the back plate and the base plate each include at least one second pin receiver adapted to cooperate with the first pin receiver, brace plate and a retention pin to selectively lock the brace plate with the back plate and the base plate, whereby the angle of the back plate and the base plate is selectively fixed.

3. The exercise apparatus of claim 2 wherein the hinge comprises one of the first pin receivers, one of the second pin receivers, and one of the retention pins.

4. The exercise apparatus of claim 3 wherein the exercise apparatus further includes a lower bench comprising:

an elongated lower shaft having a distal end having a plurality of second pin receivers adapted for engagement with the back plate, brace plate and retention pins of the foot docking station and a proximal end, a distal leg fixed with the distal end of the lower shaft at a rotational leg mount, the distal leg positionable between a retracted position aligned with and adjacent to the lower shaft, and a plurality of extended positions, the rotational leg mount including a rotational lock adapted for selective locking of the relative rotational position of the distal leg and the lower shaft, the distal leg terminating at a distal end thereof with at least one surface grip;

whereby with the proximal end of the lower shaft and the at least one surface grip of the distal leg contacting the support surface, the height and angle of the foot docking station may be established for performing the exercise on the support surface.

5. The exercise apparatus of claim 4 wherein the rotational lock of the rotational leg mount includes an axle traversing the proximal end of the distal leg, the rotational lock including at least one locking plate through which a pin can engage any one of a plurality of pin stops to selectively lock the relative rotational position of the distal leg and the lower shaft.

6. The exercise apparatus of claim 4 wherein the proximal end of the lower shaft of the lower bench further includes a receiver, and wherein the exercise apparatus further includes an upper bench comprising:

an elongated upper shaft having a proximal end and a distal end adapted for engaging the receiver of the lower shaft, a proximal leg fixed with the proximal end of the upper shaft at one of the rotational leg mounts, the proximal leg positionable between the retracted position aligned with and adjacent to the upper shaft, and a plurality of extended positions, the rotational leg mount including the rotational lock adapted for selective locking of the relative rotational position of the proximal leg and the upper shaft, the proximal leg terminating at a distal end thereof with at least one of the surface grips;

whereby with the at least one surface grip of the proximal leg contacting the support surface, the height and angle of the foot docking station and upper and lower benches may be established for performing the exercise on the apparatus.

7. The exercise apparatus of claim 6 wherein the proximal end of the upper shaft and the receiver of the lower shaft include a second pin locking mechanism, whereby a locking pin may be selectively used to lock the proximal end of the lower shaft to the distal end of the upper shaft.

8. The exercise apparatus of claim 6 wherein the rotational lock of the rotational leg mount of the upper shaft includes the axle traversing a proximal end of the proximal leg, the rotational lock including at least one of the locking plates through which the pin can engage any one of the plurality of pin stops to selectively lock the relative rotational position of the proximal leg and the upper shaft.

9. The exercise device of claim 6 wherein a pair of wheels extends past the proximal end of the upper shaft, and wherein the distal end of the lower shaft includes a pulling handle fixed thereto or formed therein, such that with the proximal and distal legs in their retracted positions, the pulling handle of the lower shaft may be lifted and pulled to roll the apparatus along the support surface upon the pair of wheels.

10. The exercise apparatus of claim 1 wherein the back plate and foot plate further include a rotational locking mechanism adapted for selectively locking the relative rotational position between the back plate and the foot plate.

11. The exercise apparatus of claim 10 wherein the rotational locking mechanism includes a plurality of locking apertures each arranged a common distance from the central pivot, and a release pin arrangement fixed with the foot plate and biased to urge the pin into one of the locking apertures, whereby pulling a release pin upward pulls the release pin out of the locking aperture to allow the foot plate to rotate about the pivot with respect to the back plate.

12. The exercise apparatus of claim 1 wherein the base plate further includes a weight rod projecting upwardly therefrom and adapted to receive at least one annular weight, whereby the apparatus is weighted to the support surface by the at least one annular weight.

* * * * *